US010381124B2

(12) United States Patent
Tahara et al.

(10) Patent No.: US 10,381,124 B2
(45) Date of Patent: Aug. 13, 2019

(54) SILVER POWDER, MANUFACTURING METHOD THEREFOR, AND CONDUCTIVE PASTE

(71) Applicant: DOWA Electronics Materials Co., Ltd., Chiyoda-ku, Tokyo (JP)

(72) Inventors: Naoki Tahara, Tokyo (JP); Hiroshi Kamiga, Tokyo (JP)

(73) Assignee: DOWA Electronics Materials Co., Ltd., Chiyoda-ku, Tokyo (JP)

( * ) Notice: Subject to any disclaimer, the term of this patent is extended or adjusted under 35 U.S.C. 154(b) by 0 days.

(21) Appl. No.: 15/754,467

(22) PCT Filed: Aug. 22, 2016

(86) PCT No.: PCT/JP2016/074383
§ 371 (c)(1),
(2) Date: Feb. 22, 2018

(87) PCT Pub. No.: WO2017/033889
PCT Pub. Date: Mar. 2, 2017

(65) Prior Publication Data

US 2018/0240566 A1 Aug. 23, 2018

(30) Foreign Application Priority Data

Aug. 24, 2015 (JP) ..... 2015-165136
Aug. 19, 2016 (JP) ..... 2016-161556

(51) Int. Cl.
*B22F 9/24* (2006.01)
*H01B 1/22* (2006.01)
*B22F 1/02* (2006.01)

(52) U.S. Cl.
CPC ..... *H01B 1/22* (2013.01); *B22F 1/02* (2013.01); *B22F 9/24* (2013.01); *B22F 2301/255* (2013.01)

(58) Field of Classification Search
CPC ..... H01B 1/22; B22F 1/02; B22F 9/24; B22F 2301/255
USPC ..... 428/403
See application file for complete search history.

(56) References Cited

U.S. PATENT DOCUMENTS

| | | | |
|---|---|---|---|
| 2011/0180764 | A1 | 7/2011 | Takahashi et al. |
| 2015/0175817 | A1 | 6/2015 | Fukaya et al. |
| 2016/0114390 | A1 | 4/2016 | Hori et al. |

FOREIGN PATENT DOCUMENTS

| | | | |
|---|---|---|---|
| CN | 102066024 | * | 6/2014 |
| JP | 2006-089768 | | 4/2006 |
| JP | 2006-097086 | | 4/2006 |
| JP | 2010-257958 | * | 11/2010 |
| JP | 2011-046992 | | 3/2011 |
| JP | 2011-140714 | | 7/2011 |
| JP | 2015-054975 | | 3/2015 |
| JP | 2015-124252 | * | 7/2015 |
| JP | 2016-119255 | | 6/2016 |
| TW | 201500290 | * | 1/2015 |
| WO | 2010/072999 | | 7/2010 |
| WO | WO2010/072999 | * | 7/2010 |

OTHER PUBLICATIONS

Japanese Patent Office, Japanese First Office Action for corresponding Japanese Application No. JP 2016-161556, dated Jul. 18, 2017.
Taiwan Intellectual Property Office, Taiwanese Office Action for corresponding Taiwanese Application No. 105126876, dated Feb. 16, 2017.

* cited by examiner

*Primary Examiner* — Leszek B Kiliman
(74) *Attorney, Agent, or Firm* — Carmody Torrance Sandak & Hennessey LLP

(57) ABSTRACT

To provide a silver powder including alkenylsuccinic anhydride and/or alkenylsuccinic acid on a surface of the silver powder.

8 Claims, 3 Drawing Sheets

SILVER POWDER, MANUFACTURING METHOD THEREFOR, AND CONDUCTIVE PASTE

TECHNICAL FIELD

The present invention relates to a silver powder, a method for producing the same, and a conductive paste.

BACKGROUND ART

Conventionally, a conductive paste obtained by dispersing a silver powder in an organic component has been used in order to form, for example, electrodes or circuits, electromagnetic wave shield films, and electromagnetic wave shield materials of electronic components.

As a silver powder for such a conductive paste, a silver powder including carboxylic acid (e.g., stearic acid and oleic acid) on the surface thereof has been proposed in order to obtain one that generates less aggregation and is excellent in dispersibility (see, for example, PTLs 1 and 2).

Moreover, a method has been proposed which includes: reducing and depositing a silver powder by adding a reducing agent to a silver-containing solution; and adding multivalent carboxylic acid such as succinic acid and adipic acid to perform a surface treatment (see, for example, PTL 3).

CITATION LIST

Patent Literature

PTL 1: Japanese Patent Application Laid-Open (JP-A) No. 2006-97086

PTL 2: JP-A No. 2006-89768

PTL 3: JP-A No. 2011-140714

SUMMARY OF INVENTION

Technical Problem

Sufficient conductivity is not exhibited by a conductive film formed by using a conductive paste including a silver powder that has carboxylic acid such as the stearic acid on the surface of the silver powder. In addition, there is a problem that when the succinic acid is used, it is not sufficiently attached on the surface of the silver powder, or the silver powder including the succinic acid on the surface of the silver powder causes aggregation over time to generate blocks.

The present invention solves the aforementioned problems in the art and aims to achieve the following object. Specifically, an object of the present invention is to provide: a silver powder, which can form a conductive film having excellent conductivity, neither causes aggregation nor generates blocks over time and has favorable storage stability; a method for producing the silver powder; and a conductive paste including the silver powder.

Solution to Problem

Means for solving the problems are as follows. That is,

<1> A silver powder including:

alkenylsuccinic anhydride and/or alkenylsuccinic acid on a surface of the silver powder.

<2> The silver powder according to <1>, wherein the alkenylsuccinic anhydride and/or alkenylsuccinic acid is at least one selected from tetrapropenylsuccinic anhydride, tetradecenylsuccinic anhydride, dodecenylsuccinic anhydride, pentadecenylsuccinic anhydride, octenylsuccinic anhydride, hexadecenylsuccinic anhydride, octadecenylsuccinic anhydride, tetrapropenylsuccinic acid, tetradecenylsuccinic acid, dodecenylsuccinic acid, pentadecenylsuccinic acid, octenylsuccinic acid, hexadecenylsuccinic acid, and octadecenylsuccinic acid.

<3> A silver powder including:

alkenylsuccinic anhydride and/or alkenylsuccinic acid having more than 12 carbon atoms in a molecule of the alkenylsuccinic anhydride and/or alkenylsuccinic acid on a surface of the silver powder.

<4> The silver powder according to <3>, wherein the alkenylsuccinic anhydride and/or alkenylsuccinic acid having more than 12 carbon atoms in the molecule of the alkenylsuccinic anhydride and/or alkenylsuccinic acid is at least one selected from tetrapropenylsuccinic anhydride, tetradecenylsuccinic anhydride, dodecenylsuccinic anhydride, pentadecenylsuccinic anhydride, tetrapropenylsuccinic acid, tetradecenylsuccinic acid, dodecenylsuccinic acid, and pentadecenylsuccinic acid.

<5> A silver powder, wherein at least alkenylsuccinic anhydride is included in a component released from a surface of the silver powder when the silver powder is heated at 300° C. and is analyzed with a gas chromatograph mass spectrometer.

<6> A conductive paste including:

the silver powder according to any one of <1> to <5>.

<7> A method for producing a silver powder, the method including:

performing a surface treatment with alkenylsuccinic anhydride.

<8> The method for producing the silver powder according to <7>, wherein the surface treatment is performed by adding alkenylsuccinic anhydride after adding a reducing agent to an aqueous solution including silver to reduce and deposit the silver powder.

<9> A method for producing a silver powder, the method including:

performing a surface treatment with alkenylsuccinic acid.

<10> A method for producing a silver powder, the method including:

adding a reducing agent to an aqueous solution including silver to reduce and deposit the silver powder and adding a metal salt of alkenylsuccinic acid to perform a surface treatment.

Advantageous Effects of Invention

According to the present invention, it is possible to solve the problems in the art and provide: a silver powder, which can form a conductive film having excellent conductivity, neither causes aggregation nor generates blocks over time and has favorable storage stability; a method for producing the silver powder; and a conductive paste including the silver powder.

DESCRIPTION OF EMBODIMENTS (Silver Powder)

Figure 1:
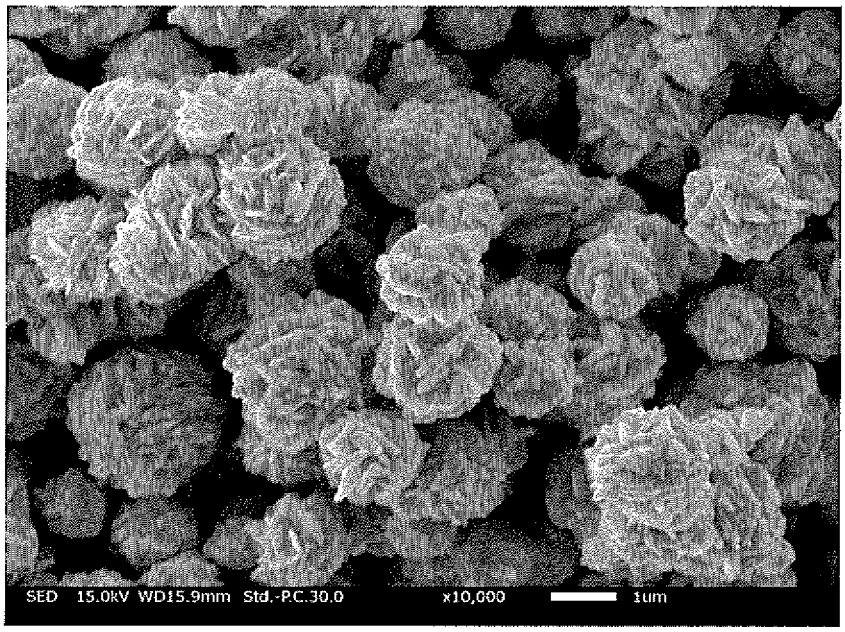
FIG. 1 is a SEM photograph (×10,000) of a silver powder produced in Example 1.

A silver powder of the present invention includes alkenylsuccinic anhydride and/or alkenylsuccinic acid on a surface of the silver powder and further includes other components if necessary.

The silver powder of the present invention includes alkenylsuccinic anhydride and/or alkenylsuccinic acid having more than 12 carbon atoms in a molecule of the alkenylsuccinic anhydride and/or alkenylsuccinic acid on a surface of the silver powder and further includes other components if necessary.

At least alkenylsuccinic anhydride is included in a component released from a surface of the silver powder when the silver powder is heated at 300° C. and is analyzed with a gas chromatograph mass spectrometer.

Here, the meaning of the phrase "includes alkenylsuccinic anhydride and/or alkenylsuccinic acid on a surface of the silver powder "includes such a state that alkenylsuccinic anhydride and/or alkenylsuccinic acid is attached on the surface of the silver powder through any manner such as adsorption or coating. Specifically, at least one part of the surface of the silver powder may include alkenylsuccinic anhydride or alkenylsuccinic acid. The whole surface of the silver powder may include alkenylsuccinic anhydride and/or alkenylsuccinic acid or a part of the surface of the silver powder may include alkenylsuccinic anhydride and/or alkenylsuccinic acid. Moreover, the inside of the silver powder may include alkenylsuccinic anhydride and/or alkenylsuccinic acid.

<Silver Powder>

As specifically described in the description of a method for producing the silver powder, which will be described hereinafter, the silver powder can be produced by a wet reduction method and includes alkenylsuccinic anhydride and/or alkenylsuccinic acid on a surface of the silver powder.

<Alkenylsuccinic Anhydride, Alkenylsuccinic Acid>

The alkenylsuccinic anhydride is succinic anhydride obtained by substituting one hydrogen atom with an alkenyl group and a structure of the alkenylsuccinic anhydride is different from a structure of succinic anhydride (anhydride of succinic acid). The succinic anhydride is an intramolecular dehydration condensate of succinic acid. When the succinic anhydride contacts with water, the succinic anhydride is hydrolyzed. Then, it returns to succinic acid and reacts with ammonia to become succinimide. In addition, the alkenylsuccinic anhydride is succinic anhydride including an alkenyl group ($—C_nH_{2n-1}$) and is different from an alkyl group ($—C_nH_{2n+1}$) substituting succinic acid.

The succinic anhydride and the alkenylsuccinic anhydride make a difference in terms of storage stability of the silver powder (occurrence of aggregation or blocks over time) because an amount of the succinic anhydride attached on the surface of the silver powder is different from an amount of the alkenylsuccinic anhydride attached on the surface of the silver powder. Moreover, when the alkenylsuccinic anhydride contacts with water, it is hydrolyzed to become alkenylsuccinic acid. When the succinic anhydride is attached on the surface of the silver powder, it becomes hydrophilic. When the alkenylsuccinic anhydride and/or alkenylsuccinic acid is attached on the surface of the silver powder, it becomes hydrophobic.

The alkenylsuccinic anhydride is preferably a compound represented by General Formula (1) below.

General Formula (1)

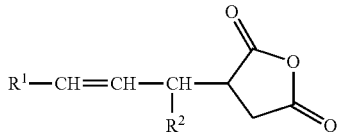

Here, in the General Formula (1), $R^1$ and $R^2$ each independently represent a hydrogen atom or a straight-chain or branched-chain alkyl group having 1 to 22 carbon atoms.

$R^1$ is preferably a straight-chain alkyl group having 5 to 13 carbon atoms, more preferably 7 to 11 carbon atoms.

$R^2$ is preferably a hydrogen atom or a straight-chain alkyl group having 1 to 3 carbon atoms, more preferably a hydrogen atom.

The position of the double bond of the alkenyl group is not limited to that in the General Formula (1) and may be a different position.

As the alkenylsuccinic anhydride, an appropriately synthesized product may be used or a commercially available product may be used. Examples of the commercially available product include: DSA and PDSA-DA (manufactured by Sanyo Chemical Industries, Ltd.); RIKACID DDSA and RIKACID OSA (manufactured by New Japan Chemical Co., Ltd.); and products manufactured by Tokyo Chemical Industry Co., Ltd. (TCI).

In one example of the above synthesis, olefin and maleic anhydride can be heated and stirred to synthesize the alkenylsuccinic anhydride.

Examples of the olefin include 1-octene, 1-decene, 1-dodecene, 1-tetradecene, internally isomerized olefins thereof, and mixtures thereof. The internally isomerized olefins thereof do not mean α-olefin (olefin in which the position of the double bond is at a position connecting carbon at 1-position and carbon at 2-position of the olefin) but mean olefin in which the double bond is positioned in any manner at an inner position of the carbon chain compared to α-position.

Note that, the alkenylsuccinic anhydride may be a structural isomer thereof or a mixture of branched chain isomers of an aliphatic chain.

Examples of the alkenylsuccinic anhydride and/or alkenylsuccinic acid include tetrapropenylsuccinic anhydride, tetradecenylsuccinic anhydride, dodecenylsuccinic anhydride, pentadecenylsuccinic anhydride, octenylsuccinic anhydride, hexadecenylsuccinic anhydride, octadecenylsuccinic anhydride, tetrapropenylsuccinic acid, tetradecenylsuccinic acid, dodecenylsuccinic acid, pentadecenylsuccinic acid, octenylsuccinic acid, hexadecenylsuccinic acid, and octadecenylsuccinic acid. These may be used alone or in combination. Among them, the number of carbon atoms in a molecule of the alkenylsuccinic anhydride and/or alkenylsuccinic acid is preferably more than 12 in terms of storage stability and pyrolytic property.

Examples of the alkenylsuccinic anhydride and/or alkenylsuccinic acid having more than 12 carbon atoms in the molecule of the alkenylsuccinic anhydride and/or alkenylsuccinic acid include tetrapropenylsuccinic anhydride, tetradecenylsuccinic anhydride, dodecenylsuccinic anhydride, pentadecenylsuccinic anhydride, tetrapropenylsuccinic acid, tetradecenylsuccinic acid, dodecenylsuccinic acid, and pentadecenylsuccinic acid. When the number of carbon atoms in the molecule of the alkenylsuccinic anhydride and/or alkenylsuccinic acid is 12 or less, storage stability is deteriorated and aggregation proceeds in terms of adsorption on the surface of the silver powder and steric hindrance. On the other hand, it was found during the process of making the present invention that as the number of carbon atoms in the molecule of fatty acid is increased, storage stability will be excellent, but a pyrolysis temperature rises to affect sinterability.

Here, structural formulas of the tetrapropenylsuccinic anhydride, the tetradecenylsuccinic anhydride, the dodecenylsuccinic anhydride, the pentadecenylsuccinic anhydride, and the octenylsuccinic anhydride will be specifically described hereinafter.

Tetrapropenylsuccinic anhydride ("TPSA", chemical formula: $C_{16}H_{26}O_3$, molecular weight 266.38, rate of oxygen atoms: 18.0%)

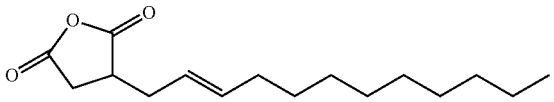

Tetradecenylsuccinic anhydride ("TDSA", chemical formula: $C_{18}H_{30}O_3$, molecular weight: 294.44, rate of oxygen atoms: 16.3%)

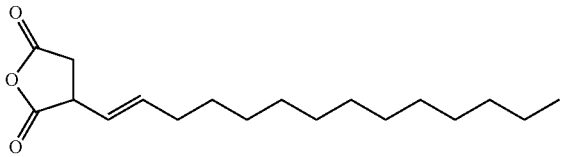

Dodecenylsuccinic anhydride ("DSA", chemical formula: $C_{16}H_{26}O_3$, molecular weight: 266.368, rate of oxygen atoms: 18.0%)

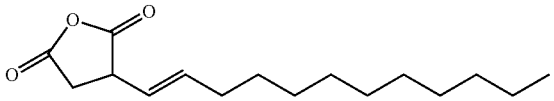

Pentadecenylsuccinic anhydride ("PDSA", chemical formula: $C_{19}H_{28}O_3$, molecular weight: 304.414, rate of oxygen atoms: 15.8%)

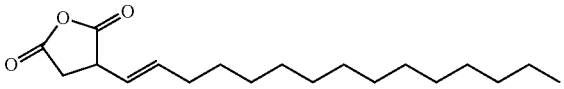

Octenylsuccinic anhydride ("OSA", chemical formula: $C_{12}H_{18}O_3$, molecular weight: 210.27)

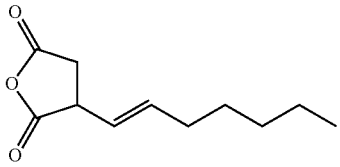

The alkenylsuccinic acid can be easily synthesized by allowing the alkenylsuccinic anhydride contact with water to be hydrolyzed. A method of the hydrolysis is not particularly limited and may be appropriately selected depending on the intended purpose. Specifically, the alkenylsuccinic anhydride may be mixed with pure water or may be mixed with an acid aqueous solution or an alkali aqueous solution. In addition, the alkenylsuccinic anhydride may be mixed with a mixture of a water-soluble organic solvent (e.g., alcohol and acetone) and water.

The alkenylsuccinic acid may be an emulsion obtained by dispersing the alkenylsuccinic anhydride in water.

The alkenylsuccinic acid may be used as a metal salt. The metal salt of the alkenylsuccinic acid may be appropriately synthesized by reacting hydroxide (e.g., alkali metal or alkaline earth metal) with the alkenylsuccinic acid and/or alkenylsuccinic acid, or a commercially available product may be used. Examples of the commercially available product include products such as LATEMULASK (potassium alkenyl succinate salt) manufactured by Kao Corporation.

Attachment of the alkenylsuccinic anhydride and/or alkenylsuccinic acid on the surface of the silver powder can be analyzed with, for example, GC-MS (gas chromatograph mass spectrometer) by heating the silver powder including alkenylsuccinic anhydride and/or alkenylsuccinic acid on the surface thereof with a pyrolyzer (EGA/Py3030D manufactured by Frontier Laboratories Ltd.) at 300° C. to release the alkenylsuccinic anhydride and/or alkenylsuccinic acid from the surface of the silver powder. In the case of the aforementioned manner, alkenylsuccinic acid on the surface of the silver powder undergoes an intramolecular dehydration condensation upon application of heat and is detected as alkenylsuccinic anhydride.

An amount of the alkenylsuccinic anhydride and/or alkenylsuccinic acid attached on the surface of the silver powder is preferably 2.0% by mass or less, more preferably 0.01% by mass or more but 1.0% by mass or less, still more preferably 0.01% by mass or more but 0.8% by mass or less, relative to mass of silver.

When the amount of the alkenylsuccinic anhydride and/or alkenylsuccinic acid attached is more than 2.0% by mass, a conductive film, which is formed of a conductive paste that includes the silver powder including alkenylsuccinic anhydride and/or alkenylsuccinic acid on the surface thereof, may be deteriorated in volume resistivity.

The amount of the alkenylsuccinic anhydride and/or alkenylsuccinic acid attached on the surface of the silver powder can be analyzed with, for example, GC-MS (gas chromatograph mass spectrometer) by preparing a calibration curve and then subjecting the alkenylsuccinic anhydride and/or alkenylsuccinic acid on the surface of the silver powder to either a pyrolyzer (EGA/Py3030D manufactured by Frontier Laboratories Ltd.) or extraction with an organic solvent.

<Other Components>

A component attached on the surface of the silver powder is not particularly limited to the alkenylsuccinic anhydride and/or alkenylsuccinic acid and may include other components. The other components are not particularly limited and may be appropriately selected depending on the intended purpose. Examples of the other components include fatty acid or a fatty acid salt other than alkenylsuccinic anhydride and/or alkenylsuccinic acid, a surfactant, an organometallic compound, a chelating agent, and a polymeric dispersant.

(Method for Producing Silver Powder)

A method of the present invention for producing the silver powder includes at least a step of performing a surface treatment with alkenylsuccinic anhydride. The surface treatment is preferably performed by adding alkenylsuccinic anhydride after adding a reducing agent to an aqueous solution including silver to reduce and deposit the silver powder. The method preferably includes a liquid preparation step of a silver ion dispersion liquid, a reduction step of silver, a surface treatment step of alkenylsuccinic anhydride, a washing step of silver powder, and a drying step of silver powder, and further includes other steps if necessary. The method may be a step of performing a surface treatment with alkenylsuccinic acid instead of the alkenylsuccinic anhydride.

A method of the present invention for producing a silver powder may include at least a step of adding a reducing agent to an aqueous solution including silver to reduce and deposit the silver powder and adding a metal salt of alkenylsuccinic acid to perform a surface treatment.

<Liquid Preparation Step of Silver Ion Dispersion Liquid>

The liquid preparation step of the silver ion dispersion liquid is a step of preparing a silver ion dispersion liquid.

As an aqueous reaction system containing silver ions, an aqueous solution or slurry containing silver nitrate, a silver complex, or a silver intermediate may be used.

The aqueous solution containing the silver complex may be formed by adding aqueous ammonia or an ammonium salt to an aqueous silver nitrate solution or a silver oxide suspension. Among them, use of an aqueous silver ammine complex solution obtained by adding aqueous ammonia to an aqueous silver nitrate solution is preferable in order to allow the silver powder to have an appropriate particle diameter and a spherical shape.

The coordination number of ammonia in the silver ammine complex is 2 and thus 2 mol or more of ammonia is added per 1 mol of silver. When the amount of ammonia is too large, the resultant complex becomes so stable that reduction does not proceed easily. Therefore, the amount of ammonia is preferably 8 mol or less per 1 mol of silver. Note that, even if the amount of ammonia exceeds 8 mol, it is still possible to obtain a spherical silver powder having an appropriate particle diameter by adjustments such as increasing the amount of the reducing agent added. Also, a pH adjusting agent may be added to the aqueous system containing the silver ions. The pH adjusting agent is not particularly limited and a general acid or a general base may be used. Examples thereof include nitric acid and sodium hydroxide.

<Reduction Step of Silver>

The reduction step of silver is a step of reducing and depositing silver with a reducing agent.

Examples of the reducing agent include ascorbic acid, sulfites, alkanolamine, aqueous hydrogen peroxide, formic acid, ammonium formate, sodium formate, glyoxal, tartaric acid, sodium hypophosphite, sodium borohydride, hydroquinone, hydrazine, hydrazine compounds, pyrogallol, glucose, gallic acid, formalin, anhydyous sodium sulphite, and Rongalite. These may be used alone or in combination. Among them, at least one selected from the group consisting of ascorbic acid, alkanolamine, sodium borohydride, hydroquinone, hydrazine, and formalin is preferable, and hydrazine and formalin are particularly preferable.

Use of the reducing agent makes it possible to obtain a silver powder having an appropriate particle diameter. An amount of the reducing agent is preferably 1 equivalent or more relative to silver in order to increase the reaction yield of silver. When a reducing agent having weak reducing force is used, an amount of the reducing agent is preferably 2 equivalents or more, more preferably 10 equivalents or more but 20 equivalents or less, relative to silver.

In a method for adding the reducing agent, addition at a speed of 1 equivalent/minute or more is preferable in order to prevent aggregation of the silver powder. Although there is no clear reason for this, one conceivable reason is as follows. Specifically, when the reducing agent is added in a short time, reduction and deposition of the silver powder occur at once. As a result, the reducing reaction is completed in a short time and aggregation of the formed nuclei does not easily occur to improve dispersibility. Therefore, the addition time of the reducing agent is preferably shorter. For example, the reducing agent may be added at a speed of 100 equivalents/minute or more. Also, upon reduction, the reaction mixture is preferably stirred so as to complete the reaction in a shorter time. Further, the liquid temperature upon the reducing reaction is preferably 5° C. or more but 80° C. or less, more preferably 15° C. or more but 40° C. or less.

The silver powder obtained is not particularly limited and may be appropriately selected depending on the intended purpose. The silver powder is preferably spherical or amorphous. Here, the "being spherical" means a silver powder satisfying the following conditions. Specifically, when the silver powder is observed with a scanning electron microscope (SEM), a shape of its particle is spherical or approximately spherical. Moreover, 100 particles of the silver powders have sphericity of 1.5 or less (sphericity: (diameter of the longest diameter portion)/(diameter of the shortest diameter portion) obtained when the particle is observed with a SEM photograph). The "being amorphous" is a silver powder where a shape of the particle is a shape excluding the spherical shape and the particle does not have a certain shape such as a cylindrical shape and a prismatic shape, when the silver powder is observed with a SEM photograph.

<Surface Treatment Step of Alkenylsuccinic Anhydride and/or Alkenylsuccinic Acid>

The surface treatment step of alkenylsuccinic anhydride is a step of subjecting the silver powder to a surface treatment with alkenylsuccinic anhydride. The surface treatment step of alkenylsuccinic anhydride may also be a step of subjecting the silver powder to a surface treatment with, instead of the alkenylsuccinic anhydride, alkenylsuccinic acid obtained by hydrolyzing alkenylsuccinic anhydride. Both alkenylsuccinic anhydride and alkenylsuccinic acid may be added thereto.

An emulsion obtained by dispersing the alkenylsuccinic anhydride in water may be added or alkenylsuccinic acid as a metal salt may be added.

It is possible to attach alkenylsuccinic anhydride and/or alkenylsuccinic acid on the surface of the silver powder by adding a reducing agent to an aqueous solution including silver to reduce and deposit the silver powder and then adding the alkenylsuccinic anhydride thereto. The surface treatment step is not limited to the above. In the surface treatment step, alkenylsuccinic anhydride may be added thereto so that alkenylsuccinic anhydride and/or alkenylsuccinic acid exists in the solution during reduction and deposition. However, it is more preferable that alkenylsuccinic anhydride be added thereto after reduction and deposition of the silver powder.

An amount of the alkenylsuccinic anhydride and/or alkenylsuccinic acid is preferably 0.05% by mass or more but 2.0% by mass or less, more preferably 0.1% by mass or more but 1.0% by mass or less, still more preferably 0.1% by mass or more but 0.8% by mass or less. Finally, through a process of attaching alkenylsuccinic anhydride on the surface of the silver powder, alkenylsuccinimide is possibly partially generated as a derivative of alkenylsuccinic anhydride.

<Collecting and Washing Step of Silver Powder>

The collecting and washing step of silver powder is a step of collecting the silver powder obtained and washing the silver powder.

The silver powder obtained is preferably washed because it contains impurity matters.

A washing solvent to be used for the washing is preferably pure water. A manner of the collecting and the washing is not particularly limited and may be appropriately selected depending on the intended purpose. Examples of the manner include decantation and filter press. An end point of the washing can be judged by using electric conductivity of water after the washing. The washing is preferably performed until the electric conductivity reaches 0.5 mS/m or less.

<Drying Step of Silver Powder>

The drying step of the silver powder is a step of drying the silver powder after the washing.

The silver powder after the washing contains much moisture and thus the moisture is needed to be removed before use. A suitable method for removing the moisture is drying in vacuum. The drying temperature is suitably set to 100° C. or less. Application of much heat is not preferable because sintering between silver powders occurs at the time of drying.

<Other Steps>

The silver powder obtained may be subjected to other steps such as a dry-type disintegration step or a classification step if necessary. Instead of the dry-type disintegration step, a surface flattening treatment may be performed. In the surface flattening treatment, the silver powder is charged into an apparatus capable of mechanically fluidizing the silver powder, and the silver powders are allowed to mechanically crush with each other to flatten irregularities and angular parts on the surface of the silver powder. Also, a classification treatment may be performed after the disintegration or the flattening treatment. Note that, drying, pulverizing, and classifying may be performed using an integrated apparatus capable of performing drying, pulverizing, and classifying (e.g., DRYMEISTER and MICRON DRYER manufacture by HOSOKAWA MICRON CORPORATION).

A silver powder including alkenylsuccinic anhydride and/or alkenylsuccinic acid on the surface thereof, which is obtained by the method of the present invention for producing the silver powder, preferably has the following characteristics.

—BET Specific Surface Area of Silver Powder—

A BET specific surface area of the silver powder can be measured with Macsorb HM-model 1210 (manufactured by MOUNTECH Co.) by the single point BET method using nitrogen adsorption. Note that, in the measurement of the BET specific surface area, degassing before the measurement is performed at 60° C. for 10 minutes.

The BET specific surface area of the silver powder is preferably 0.1 $m^2/g$ or more but 5.0 $m^2/g$ or less, more preferably 0.3 $m^2/g$ or more but 2.0 $m^2/g$ or less. When the BET specific surface area is less than 0.1 $m^2/g$, the size of the silver powder is too large and thus it is difficult to draw fine wiring in some cases. When the BET specific surface area is more than 5.0 $m^2/g$, the viscosity of a conductive paste is too high and the conductive paste needs to be diluted before use. As a result, the concentration of silver in the conductive paste becomes low and the resultant wiring may be broken.

—Particle Size Distribution of Silver Powder—

A cumulative 50% particle diameter ($D_{50}$) of the silver powder in a volume-based particle size distribution of the silver powder as measured by a laser diffraction-type particle size distribution analysis method is preferably 0.05 μm or more but 6.0 μm or less, more preferably 0.1 μm or more but 4.0 μm or less.

A ratio $[(D_{90}-D_{10})/D_{50}]$ between the $D_{50}$ and the cumulative 90% point of particle diameter ($D_{90}$) and the cumulative 10% point of particle diameter ($D_{10}$) is preferably 3.0 or less, more preferably 2.0 or less.

Similar to the BET specific surface area, when the particle size distribution of the silver powder is too large, and thus it is difficult to draw fine wiring in some cases. When the particle size distribution of the silver powder is too small, it is difficult to increase the concentration of silver in the conductive paste. Also, the silver powder is preferably one where the peak width of the particle size distribution is narrow and the particle diameter is less varied; i.e., uniform.

The particle size distribution of the silver powder can be performed through a wet laser diffraction particle size distribution measurement. The wet laser diffraction particle size distribution measurement is performed as described below. Specifically, a silver powder (0.1 g) is added to isopropyl alcohol (40 mL) and is dispersed with an ultrasonic homogenizer having a chip diameter of 20 mm for 2 minutes. A measurement device of laser diffraction scattering particle size distribution (MICROTORAC MT3300EXII manufactured by MicrotracBEL Corp.) is used to perform the measurement. Measurement results are used to make a graph and frequency and cumulation of the particle size distribution of the silver powder are determined. Then, a cumulative 10% point of particle diameter is presented as $D_{10}$, a cumulative 50% point of particle diameter is presented as $D_{50}$, and a cumulative 90% point of particle diameter is presented as $D_{90}$.

—Ignition Loss of Silver Powder—

An ignition loss of the silver powder is not particularly limited and may be appropriately selected depending on the intended purpose, but is preferably 0.02% or more but 1.00% or less.

The ignition loss of the silver powder can be determined in the following manner. Specifically, a sample of the silver powder (2 g) is weighed (w1) and is charged into a porcelain crucible. Then, the porcelain crucible is ignited for 30 minutes at 800° C. until a constant weight is reached. Then, the porcelain crucible is cooled and is weighed (w2). The (w1) and the (w2) are used to determine the ignition loss of the silver powder by the following formula.

$$\text{Ignition loss (\%)}=[(w1-w2)/w1]\times 100$$

(Conductive Paste)

A conductive paste of the present invention includes the silver powder of the present invention and polymer, and further includes other components if necessary.

An amount of the silver powder in the conductive paste is not particularly limited and may be appropriately selected depending on the intended purpose.

<Polymer>

The polymer is not particularly limited and may be appropriately selected depending on the intended purpose. Examples thereof include cellulose derivatives such as methyl cellulose and ethyl cellulose, acrylic resins, alkyd resins, polypropylene resins, polyurethane resins, rosin resins, terpene resins, phenol resins, aliphatic petroleum resins, acrylic ester resins, xylene resins, coumarone-indene resins, styrene resins, dicyclopentadiene resins, polybutene resins, polyether resins, urea resins, melamine resins, vinyl acetate resins, polyisobutyl resins, olefin-based thermoplastic elastomer (TPO), and epoxy resins. These may be used alone or in combination.

Among them, cellulose derivatives and epoxy resins are preferable.

An amount of the polymer is not particularly limited and may be appropriately selected depending on the intended purpose.

<Other Components>

Examples of the other components include a solvent, a surfactant, a glass frit, a dispersing agent, and a viscosity modifier.

The solvent is not particularly limited and may be appropriately selected depending on the intended purpose. Examples of the solvent include toluene, methyl ethyl ketone, methyl isobutyl ketone, tetradecane, tetralin, propyl alcohol, isopropyl alcohol, terpineol, dihydroterpineol, dihydroterpineol acetate, ethyl carbitol, butyl carbitol, ethyl carbitol acetate, butyl carbitol acetate, 2,2,4-trimethyl-1,3-pentanediol monoisobutyrate, and diethylene glycol mono-n-ethyl ether acetate. These may be used alone or in combination.

A method for producing the conductive paste is not particularly limited and may be appropriately selected depending on the intended purpose. For example, the conductive paste can be produced by mixing the silver powder of the present invention and the polymer, and if necessary the other components, using an ultrasonic disperser, a disper, a triple roll mill, a ball mill, a bead mill, a biaxial kneader, and a planetary centrifugal stirrer.

The conductive paste of the present invention can be printed on a substrate by, for example, screen printing, offset printing, or photolithography. In the case of the screen printing, a viscosity of the conductive paste is preferably 10 Pa·s or more but 1,000 Pa·s or less at 25° C. When the viscosity of the conductive paste is less than 10 Pa·s, "bleeding" may occur upon printing. When the viscosity of the conductive paste is more than 1,000 Pa·s, printing unevenness such as "blurring" may occur.

The viscosity of the conductive paste can be adjusted depending on an amount of the silver powder, addition of a viscosity modifier, and the kind of the solvent. The viscosity of the conductive paste can be measured with a viscometer 5XHBDV-IIIUC (manufactured by BROOKFIELD) with a cone spindle CP-52 at a temperature of the paste of 25° C.

A volume resistivity of a conductive film using the conductive paste is not particularly limited and may be appropriately selected depending on the intended purpose. The volume resistivity is preferably $1\times10^{-4}$ Ω·cm or less, more preferably $5\times10^{-5}$ Ω·cm or less, still more preferably $1\times10^{-5}$ Ω·cm or less. When the volume resistivity is $1\times10^{-4}$ Ω·cm or less, the conductive film having a considerably low volume resistivity can be achieved. When the volume resistivity is more than $1\times10^{-4}$ Ω·cm, the conductive film may have an insufficient conductivity.

The volume resistivity of the conductive film can be measured by calculating the following:

Volume resistivity=Value of resistivity×Thichkess of conductive film×Width of conductive film÷Length of conductive film, where the value of resistivity is a value of resistivity that is measured between two points in the longitudinal direction of the conductive film with a digital multimeter (R6551 manufactured by ADVANTEST).

The conductive paste of the present invention including the silver powder of the present invention can be suitably used for forming the conductive film by coating or printing the conductive paste directly on various substrates (e.g., a silicon wafer for solar cells, a film for touch panels, a glass for EL elements) or by coating or printing the conductive paste on a transparent film that has been further provided on the substrate according to the necessity.

The conductive film obtained by using the conductive paste of the present invention can be suitably used for collecting electrodes of solar cells, external electrodes of chip-type electronic components, and electrodes or electrical wirings of, for example, RFID, electromagnetic wave shields, adhesion of vibrator, membrane switches, and electroluminescence.

EXAMPLES

The present invention will be described by way of the following Examples. However, the present invention should not be construed as being limited to these Examples.

As described below, a silver powder was produced. The silver powder obtained was used to prepare a conductive paste. The conductive paste was coated and was subjected to a heating treatment to form a conductive film.

A method for measuring the BET specific surface area of the silver powder, a method for measuring the tap density of the silver powder, a method for measuring the ignition loss of the silver powder, and a method for measuring the particle size distribution ($D_{10}$, $D_{50}$, and $D_{90}$) of the silver powder are presented as described below.

<Method for Measuring BET Specific Surface Area>

The silver powder (3 g) was charged into a cell of Macsorb HM-model 1210 (manufactured by MOUNTECH) and the cell was degassed at 60° C. for 10 minutes to measure BET specific surface area of the silver powder through the single point BET method. The carrier gas used was He: 70% and $N_2$: 30%.

<Method for Measuring Tap Density>

A tap density of the silver powder was obtained with a tap density measuring device (bulk specific gravity measuring device SS-DA-2 manufactured by Shibayama Scientific Co., Ltd.). The silver powder (15 g) was weighed and was charged into a container (20 mL test tube). The tapping was performed for 1000 times at a drop of 20 mm. The tap density of the silver powder was calculated by the following formula: Tap density=Weight of the sample (15 g)/Volume of the sample after tapping <Method for Measuring Particle Size Distribution ($D_{10}$, $D_{50}$, and $D_{90}$)>

The particle size distribution of the silver powder was determined with a measurement device of laser diffraction scattering particle size distribution (MICROTORAC MT3300EXII manufactured by MicrotracBEL Corp.). Specifically, a silver powder (0.1 g) was added to isopropyl alcohol (40 mL) and was dispersed with an ultrasonic homogenizer having a chip diameter of 20 mm for 2 minutes to prepare a sample. Then, the particle diameter was measured under the total reflection mode. Then, values of a cumulative 10% point of particle diameter ($D_{10}$), a cumulative 50% point of particle diameter ($D_{50}$), and a cumulative 90% point of particle diameter ($D_{90}$) were determined based on the cumulative distribution of the volume standard obtained through the measurement.

<Ignition Loss of Silver Powder>

The ignition loss of the silver powder was determined in the following manner. Specifically, a sample of the silver powder (2 g) was weighed (w1) and was charged into a porcelain crucible. Then, the porcelain crucible was ignited for 30 minutes at 800° C. until a constant weight was reached. Then, the porcelain crucible was cooled and was weighed (w2). The (w1) and the (w2) were used to determine the ignition loss of the silver powder by the following formula.

$$\text{Ignition loss (\%)}=[(w1-w2)/w1]\times 100$$

<Qualitative Analysis of Alkenylsuccinic Anhydride and/or Alkenylsuccinic Acid on Surface of Silver Powder>

The silver powder was heated at 300° C. with a pyrolyzer (EGA/Py3030D manufactured by Frontier Laboratories Ltd.) to release alkenylsuccinic anhydride and/or alkenylsuccinic acid from the surface of the silver powder. Then, qualitative analysis of the surface of the silver powder was performed through GC-MS (gas chromatograph mass spectrometer, 7890A/5975C manufactured by Agilent Technologies Japan, Ltd.). In the above method, even when alkenylsuccinic anhydride added exists as a form of alkenylsuccinic anhydride or as a form of alkenylsuccinic acid on the surface of the silver powder, alkenylsuccinic acid undergoes an intramolecular dehydration condensation upon application of heat. Therefore, both alkenylsuccinic anhydride and alkenylsuccinic acid are detected as alkenylsuccinic anhydride.

Example 1

—Preparation of Silver Powder—

A silver nitrate solution (3,600 g) containing silver (52 g) was provided. An aqueous ammonia solution having a concentration of 28 by mass (manufactured by JUNSEI CHEMICAL CO., LTD., special grade reagent) (160 g) was added to the silver nitrate solution. Then, a 20% by mass aqueous sodium hydroxide solution (4 g) was added to the resultant solution to prepare an aqueous reaction system containing silver ions. A temperature of the solution was set to 28° C. To the aqueous reaction system containing silver ions, 37% by mass aqueous formalin solution (manufactured by Nippon Kasei Chemical Company Limited) (240 g) as a reducing agent was added and was sufficiently stirred to obtain a slurry containing silver particles.

Next, to the slurry containing silver particles obtained, tetrapropenylsuccinic anhydride (manufactured by Tokyo Chemical Industry Co., Ltd. (TCI)) (0.1 g) as a surface treatment agent was added and was sufficiently stirred to be aged. The aged slurry was filtrated and was washed with water. Then, the resultant was dried and was disintegrated to obtain a silver powder of Example 1.

FIG. 1 presents a SEM photograph (×10,000) of the obtained silver powder of Example 1 through a scanning electron microscope (SEM, JSM-6100 manufactured by JEOL Ltd.). Table 1 presents measurement results of the BET specific surface area of the silver powder obtained, the tap density of the silver powder obtained, the ignition loss of the silver powder obtained, and the particle size distribution ($D_{10}$, $D_{50}$, and $D_{90}$) of the silver powder obtained.

As a result of analysis of the silver powder through GC-MS, it was found that the tetrapropenylsuccinic anhydride was detected and tetrapropenylsuccinic anhydride and/or tetrapropenylsuccinic acid was attached on the surface of the silver powder. In addition, the ignition loss of the silver powder was 0.57%.

Figure 5:
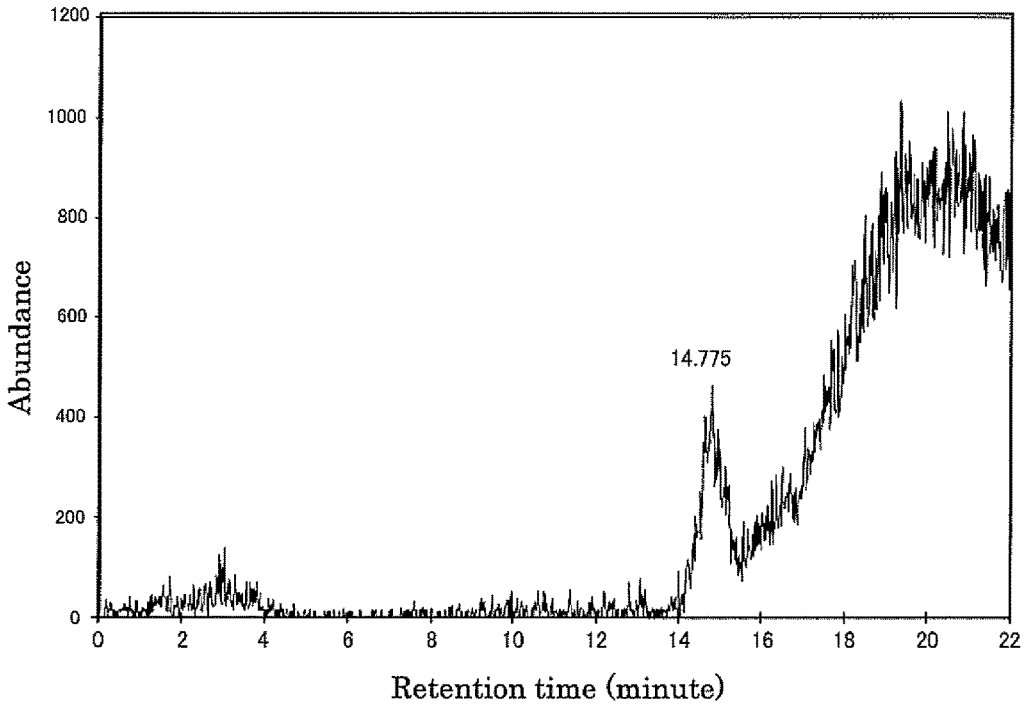
FIG. 5 is a GC-MS profile obtained by analyzing a silver powder of Example 1 using a pyrolyzer.

Here, FIG. 5 is a GC-MS profile obtained by analyzing a silver powder of Example 1 using a pyrolyzer (EGA/Py3030D manufactured by Frontier Laboratories Ltd.). This FIG. 5 is a profile extracted at a ratio (m/z) between the molecular weight and the electric charge of 266.

—Preparation of Conductive Paste—

To the silver powder obtained (90.4 parts by mass), ethyl cellulose 100 cps (manufactured by Wako Pure Chemical Industries, Ltd.) (0.8 parts by mass), and butyl carbitol acetate (manufactured by Wako Pure Chemical Industries, Ltd.) (8.8 parts by mass) were added and were mixed with a propeller-free rotation and revolution stirring defoaming apparatus (AR-250 manufactured by THINKY corporation). Then, a triple roll mill (EXAKT80S manufactured by EXAKT) was used to pass the mixture with roll gaps being gradually narrowed. As a result, a conductive paste was obtained.

Here, the viscosity of the conductive paste obtained was measured as described below. The results are presented in Table 2.

<Viscosity of Conductive Paste>

The viscosity of the conductive paste obtained was measured using a viscometer 5XHBDV-IIIUC (manufactured by BROOKFIELD) with a cone spindle CP-52 at a temperature of the paste of 25° C.

A value of the viscosity at 1 rpm (shear rate 2 $sec^{-1}$) for 5 minutes and a value of the viscosity at 5 rpm (shear rate 10 $sec^{-1}$) for 1 minute were measured.

The viscosity after 5 minutes at 1 rpm (shear rate 2 $sec^{-1}$) was adjusted to 150 Pa·s±30 Pa·s by adding butyl carbitol acetate to the paste to be diluted.

Next, a film of the prepared conductive paste was formed on a Si substrate through screen printing. The conditions of the screen printing were as follows.

- Printing device: MT-320T manufactured by Micro-tec Co., Ltd.
- Plate: line width 500 μm, routing 37.5 mm, 250 mesh, line diameter 23 μm
- Printing conditions: squeegee pressure 180 Pa, printing rate 80 mm/s, clearance 1.3 mm The film obtained was subjected to a heat treatment with an atmospheric circulation drying apparatus at 150° C. for 10 minutes. Next, firing was performed at 820° C. for 32 seconds with a high-speed firing furnace. As described above, a conductive film was produced Then, the conductive film obtained was measured for an average thickness and volume resistivity, in the following manners. The results are presented in Table 3.

<Average Thickness of Conductive Film>

A surface roughness meter (SE-30D manufactured by Kosaka Laboratory Ltd.) was used to measure an average thickness of the conductive film obtained by measuring a difference in level between a part at which no film was printed on an alumina substrate and a part at which the conductive film was formed on the alumina substrate.

<Volume Resistivity of Conductive Film>

A value of resistivity was measured with a digital multimeter (R6551 manufactured by ADVANTEST) at each position provided by dividing each conductive film in length (interval). The volume of the conductive film was determined based on the sizes (average thickness, width, and length) of each conductive film. From this volume and the value of resistivity, the volume resistivity was obtained.

Example 2

Figure 2:
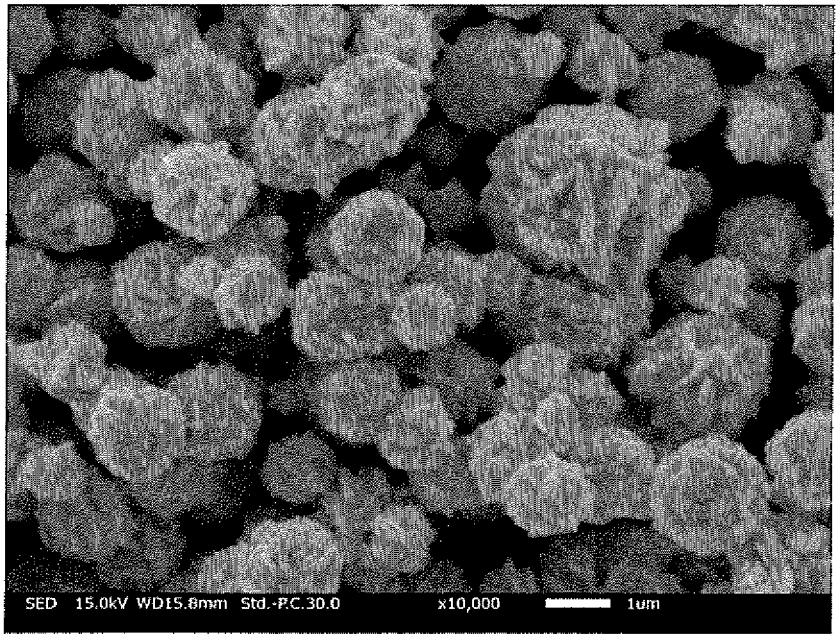
FIG. 2 is a SEM photograph (×10,000) of a silver powder produced in Example 2.

A silver powder and a conductive paste were prepared in the same manner as in Example 1 except that tetrapropenylsuccinic anhydride (0.1 g) as a surface treatment agent was changed to tetradecenylsuccinic anhydride (manufactured by Tokyo Chemical Industry Co., Ltd. (TCI)) (0.1 g). The silver powder and the conductive paste were evaluated in the same manner as in Example 1. The results are presented in Tables 1 to 3. A SEM photograph (×10,000) of the obtained silver powder of Example 2 was presented in FIG. 2.

As a result of analysis of the silver powder through GC-MS, it was found that the tetradecenylsuccinic anhydride was detected and tetradecenylsuccinic anhydride and/or tetradecenylsuccinic acid was attached on the surface of the silver powder. In addition, the ignition loss of the silver powder was 0.63%.

Example 3

A silver powder and a conductive paste were prepared in the same manner as in Example 1 except that tetrapropenylsuccinic anhydride (0.1 g) as a surface treatment agent was changed to pentadecenylsuccinic anhydride (PDSA-DA manufactured by Sanyo Chemical Industries, Ltd.) (0.1 g). The silver powder and the conductive paste were evaluated in the same manner as in Example 1. The results are presented in Tables 1 to 3.

As a result of analysis of the silver powder through GC-MS, it was found that pentadecenylsuccinic anhydride was detected and pentadecenylsuccinic anhydride and/or pentadecenylsuccinic acid was attached on the surface of the silver powder. In addition, the ignition loss of the silver powder was 0.72%.

Example 4

A silver powder and a conductive paste were prepared in the same manner as in Example 1 except that tetrapropenylsuccinic anhydride (0.1 g) as a surface treatment agent was changed to dodecenylsuccinic anhydride (RIKACID DDSA manufactured by New Japan Chemical Co., Ltd.) (0.1 g). The silver powder and the conductive paste were evaluated in the same manner as in Example 1. The results are presented in Tables 1 to 3.

As a result of analysis of the silver powder through GC-MS, it was found that dodecenylsuccinic anhydride was detected and dodecenylsuccinic anhydride and/or dodecenylsuccinic acid was attached on the surface of the silver powder. In addition, the ignition loss of the silver powder was 0.62%.

Example 5

A silver powder and a conductive paste were prepared in the same manner as in Example 1 except that tetrapropenylsuccinic anhydride (0.1 g) as a surface treatment agent was changed to octenylsuccinic anhydride (RIKACID OSA manufactured by New Japan Chemical Co., Ltd.) (0.1 g). The silver powder and the conductive paste were evaluated in the same manner as in Example 1. The results are presented in Tables 1 to 3.

As a result of analysis of the silver powder through GC-MS, it was found that octenylsuccinic anhydride was detected and octenylsuccinic anhydride and/or octenylsuccinic acid was attached on the surface of the silver powder. In addition, the ignition loss of the silver powder was 0.57%.

Comparative Example 1

Figure 3:
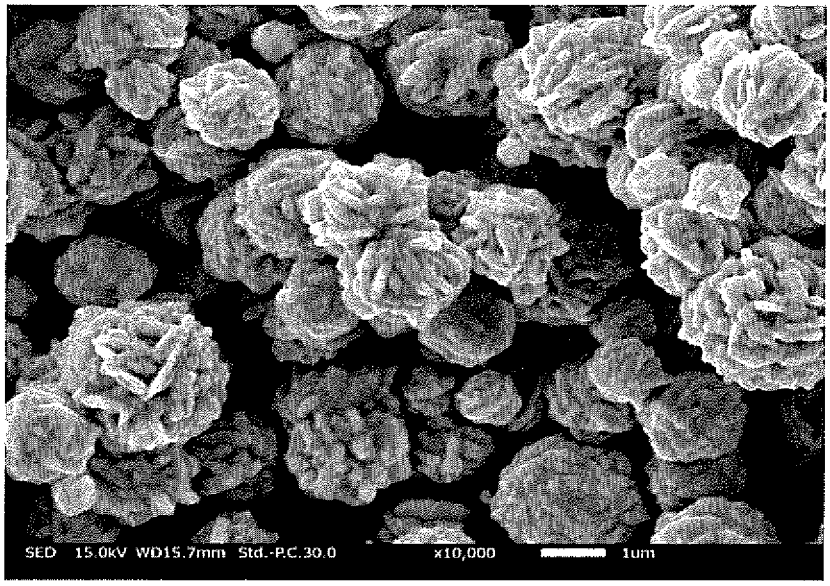
FIG. 3 is a SEM photograph (×10,000) of a silver powder produced in Comparative Example 1.

A silver powder and a conductive paste were prepared in the same manner as in Example 1 except that tetrapropenylsuccinic anhydride (0.1 g) as a surface treatment agent was changed to succinic acid (manufactured by Wako Pure Chemical Industries, Ltd., special grade reagent) (0.1 g). The silver powder and the conductive paste were evaluated in the same manner as in Example 1. The results are presented in Tables 1 to 3. A SEM photograph (×10,000) of the obtained silver powder of Comparative Example 1 was presented in FIG. 3.

As a result of analysis of the silver powder through GC-MS, it was found that succinic acid was detected and succinic acid was attached on the surface of the silver powder. In addition, the ignition loss of the silver powder was 0.56%.

Comparative Example 2

Figure 4:
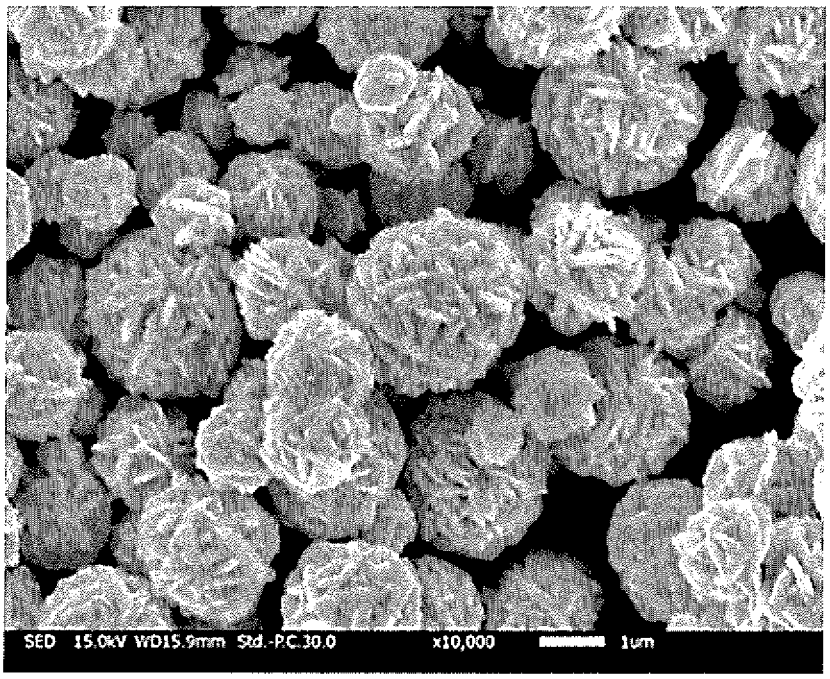
FIG. 4 is a SEM photograph (×10,000) of a silver powder produced in Comparative Example 2.

A silver powder and a conductive paste were prepared in the same manner as in Example 1 except that tetrapropenylsuccinic anhydride (0.1 g) as a surface treatment agent was changed to stearic acid (manufactured by Wako Pure Chemical Industries, Ltd., special grade reagent) (0.1 g). The silver powder and the conductive paste were evaluated in the same manner as in Example 1. The results are presented in Tables 1 to 3. A SEM photograph (×10,000) of the obtained silver powder of Comparative Example 2 was presented in FIG. 4.

As a result of analysis of the silver powder through GC-MS, it was found that stearic acid was detected and stearic acid was attached on the surface of the silver powder. In addition, the ignition loss of the silver powder was 0.67%.

Comparative Example 3

A silver powder and a conductive paste were prepared in the same manner as in Example 1 except that tetrapropenylsuccinic anhydride (0.1 g) as a surface treatment agent was changed to palmitic acid (manufactured by Wako Pure Chemical Industries, Ltd., special grade reagent) (0.1 g). The silver powder and the conductive paste were evaluated in the same manner as in Example 1. The results are presented in Tables 1 to 3.

As a result of analysis of the silver powder through GC-MS, it was found that palmitic acid was detected and palmitic acid was attached on the surface of the silver powder. In addition, the ignition loss of the silver powder was 0.75%.

TABLE 1

| | | | Silver powder | | | | | |
|---|---|---|---|---|---|---|---|---|
| | Surface treatment agent | Reducing agent | BET specific surface area ($m^2/g$) | Tap density (g/mL) | Ignition loss (%) | Particle size distribution (μm) $D_{10}$ | $D_{50}$ | $D_{90}$ |
| Example 1 | Tetrapropenylsuccinic anhydride | Formalin | 0.46 | 4.9 | 0.57 | 1.5 | 2.4 | 4.5 |

TABLE 1-continued

| | Surface treatment agent | Reducing agent | Silver powder: BET specific surface area ($m^2/g$) | Tap density (g/mL) | Ignition loss (%) | Particle size distribution (μm) $D_{10}$ | $D_{50}$ | $D_{90}$ |
|---|---|---|---|---|---|---|---|---|
| Example 2 | Tetradecenylsuccinic anhydride | Formalin | 0.47 | 5.7 | 0.63 | 1.6 | 2.5 | 4.3 |
| Example 3 | Pentadecenylsuccinic anhydride | Formalin | 0.37 | 5.6 | 0.72 | 1.7 | 2.7 | 4.4 |
| Example 4 | Dodecenylsuccinic anhydride | Formalin | 0.51 | 4.7 | 0.62 | 1.4 | 2.2 | 3.5 |
| Example 5 | Octenylsuccinic anhydride | Formalin | 0.47 | 4.1 | 0.57 | 1.6 | 2.6 | 4.2 |
| Comparative Example 1 | Succinic acid | Formalin | 0.4 | 4.7 | 0.56 | 1.7 | 3.1 | 5.2 |
| Comparative Example 2 | Stearic acid | Formalin | 0.39 | 5.4 | 0.67 | 1.4 | 2.3 | 3.8 |
| Comparative Example 3 | Palmitic acid | Formalin | 0.35 | 5.5 | 0.75 | 1.4 | 2.3 | 3.7 |

TABLE 2

| | Formulation of conductive paste and amount (% by mass): Silver powder | Ethyl cellulose 100 cps | Butyl carbitol acetate | Viscosity of conductive paste (Pa · s): 1 rpm | 5 rpm |
|---|---|---|---|---|---|
| Example 1 | 90.4 | 0.8 | 8.8 | 179 | 75 |
| Example 2 | 90.4 | 0.8 | 8.8 | 131 | 65 |
| Example 3 | 90.3 | 0.8 | 8.9 | 123 | 88 |
| Example 4 | 90.4 | 0.8 | 8.8 | 179 | 103 |
| Example 5 | 90.2 | 0.8 | 9.0 | 127 | 76 |
| Comparative Example 1 | 89.3 | 0.8 | 9.9 | 163 | 67 |
| Comparative Example 2 | 90.0 | 0.8 | 9.2 | 123 | 64 |
| Comparative Example 3 | 90.0 | 0.8 | 9.2 | 127 | 68 |

TABLE 3

| | Film properties: Actually measured resistance (Ω) | Average thickness (μm) | Volume resistivity (Ω · cm) |
|---|---|---|---|
| Example 1 | 0.064 | 27 | 2.3E−06 |
| Example 2 | 0.082 | 26 | 2.8E−06 |
| Example 3 | 0.057 | 35 | 2.7E−06 |
| Example 4 | 0.047 | 35 | 2.2E−06 |
| Example 5 | 0.053 | 36 | 2.5E−06 |
| Comparative Example 1 | 0.058 | 40 | 3.1E−06 |
| Comparative Example 2 | 0.078 | 28 | 2.9E−06 |
| Comparative Example 3 | 0.084 | 27 | 3.0E−06 |

*In the numerical values presented in the volume resistivity in Table 3, the symbol "E" means that the numerical value following the E is an "exponent" with respect to a base of 10 and the numerical value presented in front of the "E" is multiplied with the numerical value represented by an exponential function using the base of 10. For example, "1.0E−06" means "$1.0 \times 10^{-6}$".

From the above results, comparison between Examples 1 to 5 and Comparative Examples 1 to 3 indicated that when the viscosity of the conductive paste after 5 minutes at 1 rpm (shear rate 2 $sec^{-1}$) was adjusted to 150 Pa·s±30 Pa·s, the films of Examples exhibited lower volume resistivity. Adjustment of the viscosity was performed in order to perform the screen printing with each conductive paste, in both Examples and Comparative Examples under the same condition. From the above results, it was found that use of the silver powder including alkenylsuccinic anhydride and/or alkenylsuccinic acid on the surface thereof made it possible to obtain a conductive past having an excellent conductivity without changing a printing property.

During production of the conductive paste, the silver powder including stearic acid as a surface treatment agent, which was obtained in Comparative Example 2, and tetrapropenylsuccinic anhydride (0.1 g) were added to a paste to produce a conductive paste. As a result, it was found that compared to the conductive paste including the silver powder of Example 1, the conductive paste to which tetrapropenylsuccinic anhydride (0.1 g) had been further added during production of the conductive paste of Comparative Example 2 had higher viscosity and did not exhibit a special effect on conductivity. That is, it was found that rather than addition at the time of the production of the conductive paste, adsorption of alkenylsuccinic anhydride and/or alkenylsuccinic acid on the surface of the silver at the time of the production of the silver powder is necessary. Particularly, it is preferable that alkenylsuccinic anhydride and/or alkenylsuccinic acid be directly adsorbed on the surface of the silver.

The silver powder of Example 1 was mixed with toluene. Then, presence or absence of organic components eluted in toluene was examined. However, alkenylsuccinic anhydride and/or alkenylsuccinic acid was not detected. When the silver powder that had been treated with toluene was subjected to GC-MS with a pyrolyzer, alkenylsuccinic anhydride was detected. Therefore, it was found that alkenylsuccinic anhydride and/or alkenylsuccinic acid adsorbed on silver of the silver powder of the Example is not separated using toluene and alkenylsuccinic anhydride and/or alkenylsuccinic acid and silver are such firmly attached that are not separated unless heat is applied.

Moreover, the silver powder is subjected to a washing step and alkenylsuccinic anhydride and/or alkenylsuccinic acid that has not been adsorbed on silver is removed by rinse water. In the case of addition of alkenylsuccinic anhydride and/or alkenylsuccinic acid during production of the paste, it is believed that alkenylsuccinic anhydride and/or alkenylsuccinic acid that has not been adsorbed on silver is mostly included in the conductive paste. As a result, it is believed that the aforementioned difference in viscosity arises.

The aforementioned Examples and Comparative Examples are cases where the reducing agent used was formalin. Hereinafter, cases where the reducing agent used was changed from formalin to hydrazine will be described.

Example 6

A silver nitrate solution (3,200 g) containing silver (44 g) was provided. An aqueous ammonia solution having a concentration of 28% by mass (manufactured by JUNSEI CHEMICAL CO., LTD., special grade reagent) (100 g) was added to the silver nitrate solution. Then, a 20% by mass aqueous sodium hydroxide solution (16 g) was added to the solution to prepare an aqueous reaction system containing silver ions. A temperature of the solution was set to 28° C. To the aqueous reaction system containing silver ions, 80% by mass aqueous hydrazine solution (manufactured by Otsuka Chemical Co., Ltd.) (10 g) as a reducing agent was added and was sufficiently stirred to obtain a slurry containing silver particles.

Next, to the slurry containing silver particles obtained, tetrapropenylsuccinic anhydride (manufactured by Tokyo Chemical Industry Co., Ltd. (TCI)) (0.17 g) as a surface treatment agent was added and was sufficiently stirred to be aged. The aged slurry was filtrated and was washed with water. Then, the resultant was dried and was disintegrated to obtain a silver powder of Example 6.

Table 4 presents measurement results of the BET specific surface area of the silver powder obtained, the tap density of the silver powder obtained, the ignition loss of the silver powder obtained, and the particle size distribution ($D_{10}$, $D_{50}$, and $D_{90}$) of the silver powder obtained.

As a result of analysis of the silver powder through GC-MS, tetrapropenylsuccinic anhydride was detected. Therefore, it was found that tetrapropenylsuccinic anhydride and/or tetrapropenylsuccinic acid was attached on the surface of the silver powder. In addition, the ignition loss of the silver powder was 0.21%.

Example 7

A silver powder was prepared in the same manner as in Example 6 except that tetrapropenylsuccinic anhydride (0.17 g) as a surface treatment agent was changed to pentadecenylsuccinic anhydride (PDSA-DA manufactured by Sanyo Chemical Industries, Ltd.) (0.17 g). The silver powder was evaluated in the same manner as in Example 6. The results are presented in Table 4.

As a result of analysis of the silver powder through GC-MS, pentadecenylsuccinic anhydride was detected. Therefore, it was found that pentadecenylsuccinic anhydride and/or pentadecenylsuccinic acid was attached on the surface of the silver powder. In addition, the ignition loss of the silver powder was 0.27%.

Example 8

A silver powder was prepared in the same manner as in Example 6 except that tetrapropenylsuccinic anhydride (0.17 g) as a surface treatment agent was changed to dodecenylsuccinic anhydride (RIKACID DDSA manufactured by New Japan Chemical Co., Ltd.) (0.17 g). The silver powder was evaluated in the same manner as in Example 6. The results are presented in Table 4.

As a result of analysis of the silver powder through GC-MS, dodecenylsuccinic anhydride was detected. Therefore, it was found that dodecenylsuccinic anhydride and/or dodecenylsuccinic acid was attached on the surface of the silver powder. In addition, the ignition loss of the silver powder was 0.25%.

Example 9

A silver powder was prepared in the same manner as in Example 6 except that tetrapropenylsuccinic anhydride (0.17 g) as a surface treatment agent was changed to octenylsuccinic anhydride (RIKACID OSA manufactured by New Japan Chemical Co., Ltd.) (0.17 g). The silver powder was evaluated in the same manner as in Example 6. The results are presented in Table 4.

As a result of analysis of the silver powder through GC-MS, octenylsuccinic anhydride was detected. Therefore, it was found that octenylsuccinic anhydride and/or octenylsuccinic acid was attached on the surface of the silver powder. In addition, the ignition loss of the silver powder was 0.20%.

Comparative Example 4

A silver powder was prepared in the same manner as in Example 6 except that tetrapropenylsuccinic anhydride (0.17 g) as a surface treatment agent was changed to succinic acid (manufactured by Wako Pure Chemical Industries, Ltd., special grade reagent) (0.17 g). The silver powder was evaluated in the same manner as in Example 6. The results are presented in Table 4.

As a result of analysis of the silver powder through GC-MS, it was found that succinic acid was detected and succinic acid was attached on the surface of the silver powder. In addition, the ignition loss of the silver powder was 0.06%.

Comparative Example 5

A silver powder was prepared in the same manner as in Example 6 except that tetrapropenylsuccinic anhydride (0.17 g) as a surface treatment agent was changed to stearic acid (manufactured by Wako Pure Chemical Industries, Ltd., special grade reagent) (0.17 g). The silver powder was evaluated in the same manner as in Example 6. The results are presented in Table 4.

As a result of analysis of the silver powder through GC-MS, it was found that stearic acid was detected and stearic acid was attached on the surface of the silver powder. In addition, the ignition loss of the silver powder was 0.42%.

TABLE 4

| | | | Silver powder | | | | | |
|---|---|---|---|---|---|---|---|---|
| | Surface treatment agent | Reducing agent | BET specific surface area ($m^2/g$) | Tap density (g/mL) | Ignition loss (%) | Particle size distribution (μm) $D_{10}$ | $D_{50}$ | $D_{90}$ |
| Example 6 | Tetrapropenylsuccinic anhydride | Hydrazine | 1.50 | 3.7 | 0.21 | 0.3 | 0.9 | 1.6 |
| Example 7 | Pentadecenylsuccinic anhydride | Hydrazine | 1.48 | 3.3 | 0.27 | 0.3 | 0.8 | 1.5 |

TABLE 4-continued

| | Surface treatment agent | Reducing agent | Silver powder: BET specific surface area ($m^2/g$) | Tap density (g/mL) | Ignition loss (%) | Particle size distribution (μm) $D_{10}$ | $D_{50}$ | $D_{90}$ |
|---|---|---|---|---|---|---|---|---|
| Example 8 | Dodecenylsuccinic anhydride | Hydrazine | 1.57 | 3.5 | 0.25 | 0.3 | 0.8 | 1.5 |
| Example 9 | Octenylsuccinic anhydride | Hydrazine | 1.46 | 2.3 | 0.20 | 1.4 | 2.7 | 4.8 |
| Comparative Example 4 | Succinic acid | Hydrazine | 0.87 | 1.9 | 0.06 | 2.6 | 5.7 | 11.0 |
| Comparative Example 5 | Stearic acid | Hydrazine | 1.25 | 4.4 | 0.42 | 0.5 | 1.4 | 2.4 |

From the above results, it was found that the cumulative 50% point of particle diameter ($D_{50}$) of the silver powder of Example 9 was larger compared to those of Examples 6 to 8, resulting in aggregation and coarse particles. Unlike in Example 5, it is believed that when the silver powders, which have a small particle diameter and are obtained by using hydrazine as a reducing agent, were used, aggregation immediately occurred. It was found that octenylsuccinic anhydride having 12 carbon atoms was not preferable for the silver powder in some cases.

Next, in Examples 6 to 8 and Comparative Examples 4 and 5, the silver powder obtained was used to prepare a conductive paste as described below. Then, viscosity of the conductive paste, an average thickness of the conductive film, and volume resistivity of the conductive film were evaluated as described below. Unlike Examples 1 to 5 and Comparative Examples 1 to 3, each viscosity was not adjusted so as to reach a certain range. Therefore, in Examples 6 to 8 and Comparative Examples 4 and 5, the conductive pastes having the same formulation were evaluated for each value including the viscosity.

—Preparation of Conductive Paste—

To the silver powder obtained (86.3 parts by mass), Ethyl cellulose 100 cps (manufactured by Wako Pure Chemical Industries, Ltd.) (0.8 parts by mass) and butyl carbitol acetate (manufactured by Wako Pure Chemical Industries, Ltd.) (12.9 parts by mass) were added and were mixed with a propeller-free rotation and revolution stirring defoaming apparatus (AR-250 manufactured by THINKY corporation). Then, a triple roll mill (EXAKT80S manufactured by EXAKT) was used to pass the mixture with roll gaps being gradually narrowed. As a result, a conductive paste was obtained.

<Viscosity of Conductive Paste>

The viscosity of the conductive paste obtained was measured using a viscometer 5XHBDV-IIIUC (manufactured by BROOKFIELD) with a cone spindle CP-52 at a temperature of the paste of 25° C.

A value of the viscosity at 1 rpm (shear rate 2 sec-1) for 5 minutes and a value of the viscosity at 5 rpm (shear rate 10 $sec^{-1}$) for 1 minute were measured. Measurement results of the viscosity are presented in Table 5.

Next, a film of the prepared conductive paste was formed on a Si substrate through screen printing. The conditions of the screen printing were as follows.

Printing device: MT-320T manufactured by Micro-tee Co., Ltd.

Plate: line width 500 μm, routing 37.5 mm, 250 mesh, line diameter 23 μm

Printing conditions: squeegee pressure 180 Pa, printing rate 80 mm/s, clearance 1.3 mm The film obtained was subjected to a heat treatment with an atmospheric circulation drying apparatus at 150° C. for 10 minutes. Next, firing was performed at 820° C. for 32 seconds with a high-speed firing furnace. As described above, a conductive film was produced.

Then, the conductive film obtained was measured for an average thickness and volume resistivity, in the following manners. The results are presented in Table 6.

<Average Thickness of Conductive Paste>

A surface roughness meter (SURFCOM 480B-12 manufactured by TOKYO SEIMITSU CO., LTD.) was used to measure an average thickness of the conductive film obtained by measuring a difference in level between a part at which no film was printed on a Si substrate and a part at which the conductive film was formed on the Si substrate.

<Volume Resistivity of Conductive Film>

A value of resistivity was measured with a digital multimeter (R6551 manufactured by ADVANTEST) at each position provided by dividing each conductive film in length (interval). The volume of the conductive film was determined based on the sizes (average thickness, width, and length) of each conductive film. From this volume and the value of resistivity, the volume resistivity was obtained.

TABLE 5

| | Formulation of conductive paste and amount (% by mass): Silver powder | Ethyl cellulose 100 cps | Butyl carbitol acetate | Viscosity of conductive paste (Pa · s): 1 rpm | 5 rpm |
|---|---|---|---|---|---|
| Example 6 | 86.3 | 0.8 | 12.9 | 44 | 14 |
| Example 7 | 86.3 | 0.8 | 12.9 | 28 | 10 |
| Example 8 | 86.3 | 0.8 | 12.9 | 52 | 17 |
| Comparative Example 4 | 86.3 | 0.8 | 12.9 | 40 | 22 |
| Comparative Example 5 | 86.3 | 0.8 | 12.9 | 79 | 21 |

TABLE 6

| | Film properties: Actually measured resistance (Ω) | Average thickness (μm) | Volume resistivity (Ω · cm) |
|---|---|---|---|
| Example 6 | 0.137 | 12 | 2.25E−06 |
| Example 7 | 0.140 | 11 | 2.14E−06 |
| Example 8 | 0.139 | 12 | 2.28E−06 |

TABLE 6-continued

| | Film properties | | |
|---|---|---|---|
| | Actually measured resistance (Ω) | Average thickness (μm) | Volume resistivity (Ω · cm) |
| Comparative Example 4 | 0.142 | 23 | 4.44E−06 |
| Comparative Example 5 | 0.141 | 12 | 2.32E−06 |

The above results indicate that the films of Examples 6 to 8 were decreased in volume resistivity compared to the films of Comparative Examples 4 and 5. Therefore, it was found that incorporation of alkenylsuccinic anhydride and/or alkenylsuccinic acid on the surface makes it possible to obtain a conductive paste having an excellent conductivity.

<Storage Stability Test of Silver Powder>

Next, the silver powder of Example 1, the silver powder of Example 5, and the silver powder of Comparative Example 1 were used to perform a storage stability test as described below. The results are presented in Table 7.

—Storage Stability Test—

Each (5 g) of the silver powder of Example 1, the silver powder of Example 5, and the silver powder of Comparative Example 1 was charged into a container made of glass and was left to stand at room temperature (25° C.) for 2 months. The cumulative 50% point of particle diameter ($D_{50}$) before and after the silver powder was left to stand for 2 months was measured. Whether aggregation and occurrence of blocks arise was visually evaluated after the silver powder was left to stand for 2 month.

TABLE 7

| | $D_{50}$ (μm) | | |
|---|---|---|---|
| | Initial stage | Left to stand for 2 months | Evaluation of appearance |
| Example 1 | 2.4 | 2.4 | Even after the silver powder was left to stand for 2 months, neither aggregation nor block was generated. |
| Example 5 | 2.6 | 2.9 | After the silver powder was left to stand for 2 months, aggregation was slightly generated. |
| Comparative Example 1 | 3.1 | 3.9 | After the silver powder was left to stand for 2 month, both aggregation and block were generated. |

From the results in Table 7, it was found that silver powders of Examples 1 and 5 including alkenylsuccinic anhydride and/or alkenylsuccinic acid on the surface thereof exhibit higher storage stability compared to the silver powder of Comparative Example 1 including succinic acid on the surface thereof. Comparison between Example 1 (the number of carbon atoms of tetrapropenylsuccinic anhydride: 16) and Example 5 (the number of carbon atoms of octenylsuccinic anhydride: 12) indicated that alkenylsuccinic anhydride and/or alkenylsuccinic acid having more than 12 carbon atoms in the molecule thereof can be further improved in storage stability compared to alkenylsuccinic anhydride and/or alkenylsuccinic acid having 12 or less carbon atoms in the molecule thereof.

Example 10

A silver powder and a conductive paste were prepared in the same manner as in Example 1 except that tetrapropenylsuccinic anhydride (0.1 g) as a surface treatment agent was changed to potassium alkenyl succinate salt (manufactured by Kao Corporation, product name: LATEMUL ASK, the structure is not disclosed, solid concentration 28% by mass) (0.5 g). The silver powder and the conductive paste were evaluated in the same manner as in Example 1. The results are presented in Table 8, Table 9, and Table 10.

As a result of analysis of the silver powder through GC-MS, it was found that octadecenylsuccinic anhydride was detected and octadecenylsuccinic anhydride and/or octadecenylsuccinic acid was attached on the surface of the silver powder. In addition, the ignition loss of the silver powder was 0.53%.

TABLE 8

| | | | Silver powder | | | | | |
|---|---|---|---|---|---|---|---|---|
| | Surface treatment agent | Reducing agent | BET specific surface area ($m^2$/g) | Tap density (g/mL) | Ignition loss (%) | Particle size distribution (μm) $D_{10}$ | $D_{50}$ | $D_{90}$ |
| Example 10 | LATEMUL ASK (potassium alkenyl succinate salt) | Formalin | 0.49 | 4.5 | 0.53 | 1.4 | 2.9 | 5.2 |

TABLE 9

| | Formulation of conductive paste and amount (% by mass) | | | Viscosity of conductive paste (Pa · s) | |
|---|---|---|---|---|---|
| | Silver powder | Ethyl cellulose 100 cps | Butyl carbitol acetate | 1 rpm | 5 rpm |
| Example 10 | 91.7 | 0.8 | 7.5 | 155 | 82 |

TABLE 10

| | Film properties | | |
|---|---|---|---|
| | Actually measured resistance (Ω) | Average thickness (μm) | Volume resistivity (Ω · cm) |
| Example 10 | 0.085 | 22 | 2.4E−06 |

From the above results, as with Examples 1 to 5, it was found that the film of Example 10 has lower volume resistivity compared to the films of Comparative Examples 1 to 3. From the above results, it was found that even when a metal salt of alkenylsuccinic acid was used, it is also possible to obtain a conductive paste having an excellent conductivity without changing a printing property.

INDUSTRIAL APPLICABILITY

The conductive paste including the silver powder of the present invention can be suitably used for forming the conductive coated film by coating or printing the conductive paste directly on various substrates (e.g., a silicon wafer for solar cells, a film for touch panels, a glass for EL elements) or by coating or printing the conductive paste on a transparent film that has been further provided on the substrate according to the necessity. The conductive film can be suitably used for collecting electrodes of solar cells, external electrodes of chip-type electronic components, and electrodes or electrical wirings of, for example, RFID, electromagnetic wave shields, adhesion of vibrator, membrane switches, and electroluminescence.

The invention claimed is:

1. A silver powder consisting of a surface treatment agent selected from alkenylsuccinic anhydride and/or alkenylsuccinic acid on a surface of the silver powder.

2. The silver powder according to claim 1, wherein the alkenylsuccinic anhydride and/or alkenylsuccinic acid is at least one selected from tetrapropenylsuccinic anhydride, tetradecenylsuccinic anhydride, dodecenylsuccinic anhydride, pentadecenylsuccinic anhydride, octenylsuccinic anhydride, hexadecenylsuccinic anhydride, octadecenylsuccinic anhydride, tetrapropenylsuccinic acid, tetradecenylsuccinic acid, dodecenylsuccinic acid, pentadecenylsuccinic acid, octenylsuccinic acid, hexadecenylsuccinic acid, and octadecenylsuccinic acid.

3. The silver powder according to claim 1, wherein the alkenylsuccinic anhydride and/or alkenylsuccinic acid has more than 12 carbon atoms in a molecule of the alkenylsuccinic anhydride and/or alkenylsuccinic acid.

4. The silver powder according to claim 3, wherein the alkenylsuccinic anhydride and/or alkenylsuccinic acid is at least one selected from tetrapropenylsuccinic anhydride, tetradecenylsuccinic anhydride, dodecenylsuccinic anhydride, pentadecenylsuccinic anhydride, tetrapropenylsuccinic acid, tetradecenylsuccinic acid, dodecenylsuccinic acid, and pentadecenylsuccinic acid.

5. A conductive paste comprising the silver powder according to claim 1 and a cellulose derivative.

6. A silver powder consisting of a surface treatment agent on a surface of the silver powder, wherein the surface treatment agent is detected as alkenylsuccinic anhydride when the silver powder is heated at 300° C. and is analyzed with a gas chromatograph mass spectrometer.

7. A conductive paste comprising: the silver powder according to claim 6 and a cellulose derivative.

8. A method for producing a silver powder by adding a reducing agent to an aqueous solution including silver to reduce and deposit the silver powder, the method comprising:

adding, to liquid during or after reduction and deposition of the silver powder, at least one selected from alkenylsuccinic anhydride, alkenylsuccinic acid, and an metal salt of alkenylsuccinic acid as a surface treatment agent, to obtain the silver powder consisting of the surface treatment agent selected from alkenylsuccinic anhydride and/or alkenylsuccinic acid on a surface of the silver powder.

* * * * *